US010335970B2

(12) United States Patent
Hashimoto

(10) Patent No.: US 10,335,970 B2
(45) Date of Patent: Jul. 2, 2019

(54) RAZOR WITH DETACHABLE REPLACEMENT BLADE

(71) Applicant: KAI R&D CENTER CO., LTD., Seki-shi (JP)

(72) Inventor: Kengo Hashimoto, Seki (JP)

(73) Assignee: KAI R&D CENTER CO., LTD. (JP)

( * ) Notice: Subject to any disclaimer, the term of this patent is extended or adjusted under 35 U.S.C. 154(b) by 0 days.

(21) Appl. No.: 15/028,636

(22) PCT Filed: Oct. 8, 2014

(86) PCT No.: PCT/JP2014/076978
§ 371 (c)(1),
(2) Date: Apr. 11, 2016

(87) PCT Pub. No.: WO2015/056621
PCT Pub. Date: Apr. 23, 2015

(65) Prior Publication Data

US 2016/0250764 A1 Sep. 1, 2016

(30) Foreign Application Priority Data

Oct. 15, 2013 (JP) ..... 2013-214860

(51) Int. Cl.
*B26B 21/52* (2006.01)
*B26B 21/22* (2006.01)

(52) U.S. Cl.
CPC ..... *B26B 21/521* (2013.01); *B26B 21/225* (2013.01)

(58) Field of Classification Search
CPC ..... B26B 21/521; B26B 21/225; B26B 21/52
(Continued)

(56) References Cited

U.S. PATENT DOCUMENTS 4,797,998 A 1/1989 Motta
5,093,991 A 3/1992 Hendrickson
(Continued)

FOREIGN PATENT DOCUMENTS

CN 101687326 A 3/2010
GB 2458316 A * 9/2009 ..... B26B 21/14
(Continued)

OTHER PUBLICATIONS

Definition of "annular" accessed at https://www.merriam-webster.com/dictionary/annular on May 16, 2018.*
(Continued)

*Primary Examiner* — Evan H MacFarlane
(74) *Attorney, Agent, or Firm* — Tarolli, Sundheim, Covell & Tummino LLP

(57) ABSTRACT

A razor blade cartridge is detachably attached to a holder. A socket portion is provided to the holder. A coupler projection, which detachably attaches to the socket portion through the insertion/ejection opening of the socket portion, is provided to the blade cartridge. A guide portion, which extends towards the opposite side from the skin contacting surface of the blade cartridge and is supported by the socket portion of the holder, is provided to the coupler projection of the blade cartridge. The end of the guide portion is provided with a manipulation portion, which is manipulated at the manipulation opening of the socket portion to release the guide portion from the socket portion and the manipulation of which removes the blade cartridge from the insertion/ejection opening of the socket portion. Thus, the blade cartridge can be easily removed by a gentle application of pressure on the manipulation portion.

9 Claims, 4 Drawing Sheets

(58) Field of Classification Search
USPC ..... 30/47–51, 526, 527
See application file for complete search history.

(56) References Cited

U.S. PATENT DOCUMENTS

| | | | | |
|---|---|---|---|---|
| 8,205,344 | B2 * | 6/2012 | Stevens | B26B 21/225 30/526 |
| 2006/0242847 | A1 * | 11/2006 | Dansreau | B26B 21/38 30/526 |
| 2010/0132204 | A1 * | 6/2010 | Brown | B26B 21/521 30/527 |
| 2010/0180446 | A1 | 7/2010 | Shimizu et al. | |
| 2011/0088269 | A1 | 4/2011 | Walker, Jr. et al. | |
| 2014/0096402 | A1 | 4/2014 | Nakasuka et al. | |

FOREIGN PATENT DOCUMENTS

| | | | | |
|---|---|---|---|---|
| JP | 61-12488 | U | 1/1986 | |
| JP | 2005-218646 | A | 8/2005 | |
| JP | 2012-254280 | A | 12/2012 | |
| WO | WO-2012157624 | A1 * | 11/2012 | B26B 1/225 |
| WO | 2014/075844 | A1 | 5/2014 | |

OTHER PUBLICATIONS

International Preliminary Report on Patentability for Application No. PCT/JP2014/076978 dated Apr. 19, 2016.
Chinese Office Action for Application No. 201480056408.9 dated Jan. 4, 2017.
International Search Report for Application No. PCT/JP2014/076978 dated Dec. 9, 2014.
Extended European Search Report for Application No. 14853439.9 dated May 26, 2017.

* cited by examiner

RAZOR WITH DETACHABLE REPLACEMENT BLADE

RELATED APPLICATIONS

The present invention is a U.S. National Stage under 35 USC 371 patent application, claiming priority to Serial No. PCT/JP2014/076978, filed on 8 Oct. 2014; which claims priority from JP 2013-214860, filed 15 Oct. 2013, the entirety of both of which are incorporated herein by reference.

BACKGROUND OF THE INVENTION

The present invention relates to a razor with a detachable blade cartridge that allows a blade cartridge to be detachably coupled to a holder.

Patent Document 1 discloses a razor with a detachable blade cartridge that has a holder having a head portion. The head portion has a coupler hole with an insertion/ejection opening. The blade base of the blade cartridge has a coupler projection, which allows the blade cartridge to be detachably coupled to the coupler hole through the insertion/ejection opening. The coupler projection of the blade cartridge has a guide portion, which allows the coupler projection to be held by the coupler hole. The coupler projection of the blade cartridge has a manipulation portion, which is manipulated to ejecting the blade cartridge from the attachment opening of the coupler hole, thereby canceling the holding of the coupler projection to the coupler hole by the guide portion of the coupler projection.

PRIOR ART DOCUMENTS

Patent Documents

Patent Document 1: Japanese Laid-Open Utility Model Publication No. 61-12488

SUMMARY OF THE INVENTION

In the razor of Patent Document 1, when the coupler projection of the blade cartridge is held in the coupler hole of the holder, the manipulation portion is exposed at a position adjacent to the blade base of the blade cartridge in the outer periphery of the coupler projection. Thus, when the blade cartridge is ejected from the insertion/ejection opening of the coupler hole, it is difficult to apply a sufficient pushing force to the manipulation portion by pushing the manipulation portion in the ejection direction.

Patent Document 1 discloses another razor in which the coupler hole of the head portion of the holder has, in addition to the insertion/ejection opening, a manipulation opening, which exposes the manipulation portion. In the second razor, the manipulation portion is pressed down in a direction intersecting the ejection direction of the blade cartridge to disengage the manipulation portion from the manipulation opening. Then, the manipulation portion needs to be moved in the ejection direction of the blade cartridge to eject the blade cartridge from the insertion/ejection opening of the coupler hole. This requires two-stage manipulation.

It is an objective of the present invention to provide a razor with a detachable blade cartridge that allows a manipulation portion to readily receive a pushing force so that the blade cartridge can be easily removed when the manipulation portion is pushed in an ejection direction of the blade cartridge to eject the blade cartridge from an insertion/ejection opening of a socket portion such as a coupler hole.

To achieve the foregoing objective and in accordance with one aspect of the present invention, a razor is provided that includes a holder and a blade cartridge, which has a skin contacting surface and is detachably attached to the holder. The razor further includes a socket portion, a coupler projection, a guide portion, and a manipulation portion. The socket portion is provided in the holder and includes an insertion/ejection opening and a manipulation opening. The coupler projection is provided in the blade cartridge and is detachably coupled to the socket portion of the holder. The guide portion is provided in the coupler projection of the blade cartridge, extends in an opposite direction from the skin contacting surface of the blade cartridge, and is held by the socket portion of the holder. The manipulation portion is provided in the vicinity of an end of the guide portion. To cancel the holding of the guide portion by the socket portion, the manipulation portion is manipulated in the vicinity of the manipulation opening of the socket portion, so that the blade cartridge is removed from the insertion/ejection opening of the socket portion.

This configuration allows the blade cartridge to be easily removed through a single-stage manipulation, in which the manipulation portion of the coupler projection is pushed in the ejection direction to remove the blade cartridge from the insertion/ejection opening of the socket portion. Further, a pushing force can be easily applied to the manipulation portion provided in the vicinity of the end of the guide portion.

The manipulation of the coupler projection is preferably exposed to an outside from the socket portion of the holder via the manipulation opening. In this case, the manipulation portion, which is exposed from the manipulation opening of the socket portion, easily receives a pushing force, allowing the blade cartridge to be easily removed.

A central axis that extends through the insertion/ejection opening and the manipulation opening of the socket portion preferably extends in a direction in which the guide portion of the coupler projection extends. In this case, the pushing force applied to the manipulation portion of the coupler projection is readily transmitted to the blade cartridge, so that the blade cartridge is easily removed.

The manipulation portion of the coupler projection is preferably provided in a support portion provided in the guide portion of the coupler projection. In this case, the manipulation portion is easily provided on the guide portion via the support portion in the coupler projection of the blade cartridge.

The support portion of the guide portion preferably includes an engagement portion having an elasticity. The engagement portion is preferably switchable between a state in which the engagement portion is capable of engaging the coupler projection with the socket portion of the holder through elastic deformation and a state in which the engagement portion is capable of disengaging the coupler projection from the socket portion against the elasticity of the engagement portion. In this case, the engagement portion of the support portion allows the coupler projection to be easily engaged with or disengaged from the socket portion of the holder.

The support portion of the guide portion is preferably constituted by a cantilever spring having the engagement portion, and the manipulation portion is preferably provided in the vicinity of a distal end of the support portion. In this case, the manipulation portion at the distal end of the support portion, which has the engagement portion, allows the coupler projection of the blade cartridge to be easily engaged with or disengaged from the socket portion of the holder.

The engagement portion of the support portion is preferably a step portion that is engaged with and disengaged from an edge of the manipulation opening of the socket portion. In this case, the structure of the engagement portion is simplified.

The manipulation portion of the coupler projection preferably has a pusher surface that is inclined in relation to a direction in which the coupler projection is inserted into and ejected from the socket portion of the holder. In this case, the pushing force generated by pushing the pusher surface of the manipulation portion deforms the support portion, which allows the coupler projection to be easily engaged with or disengaged from the socket portion of the holder. Also, the blade cartridge is ejected from the insertion/ejection opening, thereby canceling the holding of the guide portion to the socket portion.

The holder preferably includes a grip portion, which is continuous with a head portion in which the socket portion is provided, and the pusher surface of the manipulation portion preferably extends in a longitudinal direction of the grip portion and toward the head portion and is inclined away from the skin contacting surface. In this case, the pushing force generated by pushing the pusher surface of the manipulation portion with a finger holding the grip portion deforms the support portion and allows the coupler projection to be easily engaged with or disengaged from the socket portion of the holder. Also, the blade cartridge can be ejected from the insertion/ejection opening, thereby canceling the holding of the guide portion to the socket portion.

The holder preferably has a coupler hole, which extends through the socket portion. The coupler hole is preferably open at the insertion/ejection opening and at the manipulation opening, and the guide portion of the coupler projection is preferably held in the coupler hole. In this case, the socket portion has a simple structure in the holder.

The blade cartridge preferably has a blade assembly, in which the guide portion of the coupler projection extends. With the guide portion of the coupler projection coupled to the socket portion of the holder, the socket portion is preferably held between the blade assembly of the blade cartridge and the engagement portion of the support portion. In this case, the blade cartridge is prevented from coming off the socket portion of the holder.

The socket portion of the holder and the guide portion of the coupler projection of the blade cartridge preferably each have a restriction portion. The razor is preferably configured to be switchable between a holding-enabled state, in which, with cutting edges of blades in the blade cartridge oriented in a forward direction, the restriction portion of the socket portion and the restriction portion of the guide portion slide on each other to permit the coupler projection to be inserted into the socket portion, and a holding-disabled state, in which, if an orientation of the blade cartridge is reversed so that the cutting edges of the blades are oriented in a reverse direction, the restriction portion of the socket portion and the restriction portion of the guide portion restrict insertion of the coupler projection into the socket portion. In this case, the restriction portion of the socket portion and the restriction portion of the guide portion determine the holding position of the guide portion in relation to the socket portion.

The razor with a detachable blade cartridge according to the present invention allows a blade cartridge to be easily removed from the holder.

DETAILED DESCRIPTION OF THE PREFERRED EMBODIMENTS

A razor with a detachable blade cartridge according to one embodiment of the present invention will now be described with reference to the drawings. A neutral state in which the razor is not in use will be mainly discussed below.

Figure 1:
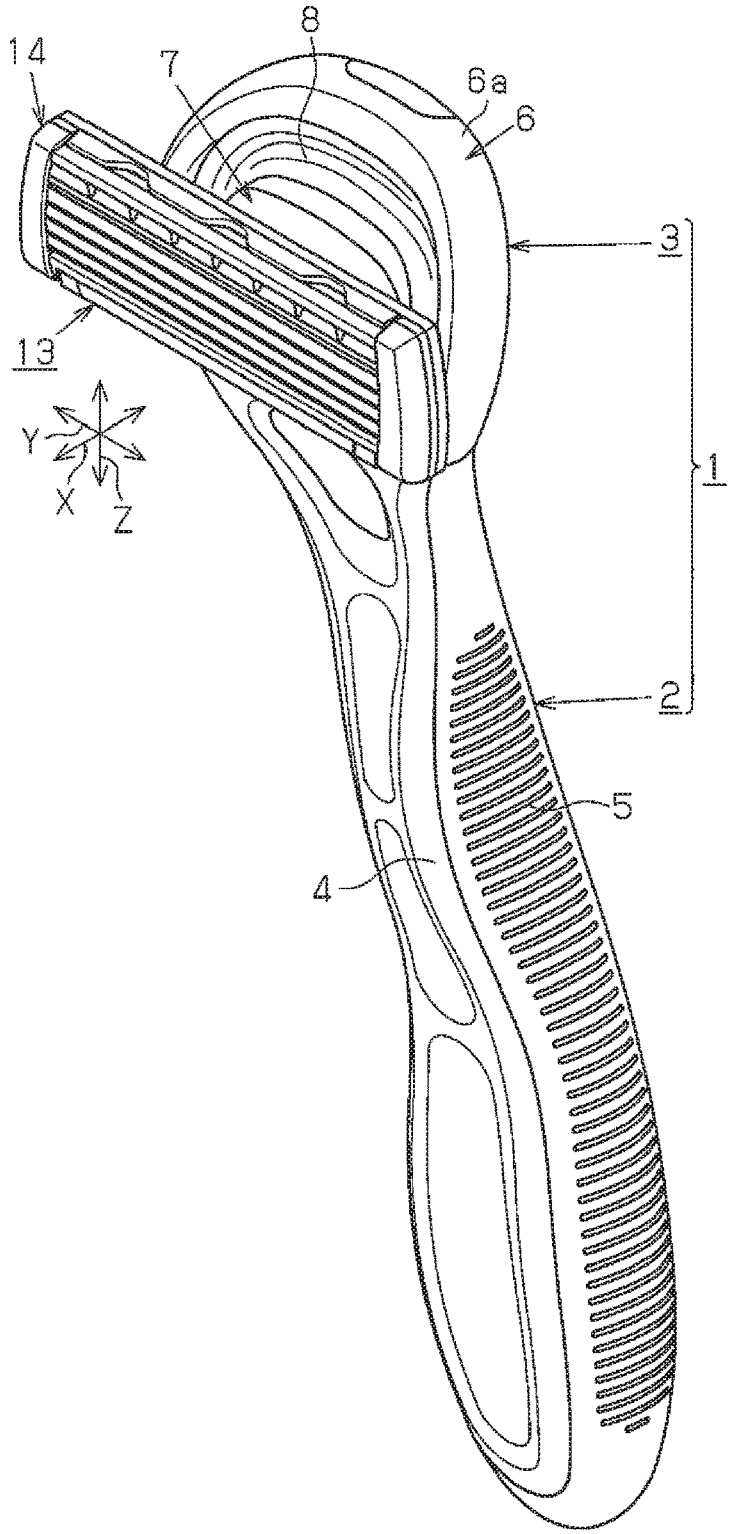
FIG. 1 is a perspective front view illustrating an assembled state of a razor with a detachable blade cartridge.

As shown in FIG. 1, a holder 1 includes an elongated grip portion 2, which extends along a vertical axis Z, and a head portion 3, which is attached to the upper end of the grip portion 2. The grip portion 2 includes a main body portion 4, which is molded from a hard plastic such as an ABS plastic, and an exposed finger contact portion 5, which is located on the outer surface of the main body portion 4 and is molded from a rubber material or a soft plastic such as an elastomer plastic and a silicone plastic. The head portion 3 has a support portion 6. The support portion 6 is integrally molded with the main body portion 4 of the grip portion 2 from the same hard plastic as that of the main body portion 4. The support portion 6 has an annular portion 6*a*.

Figure 2B:
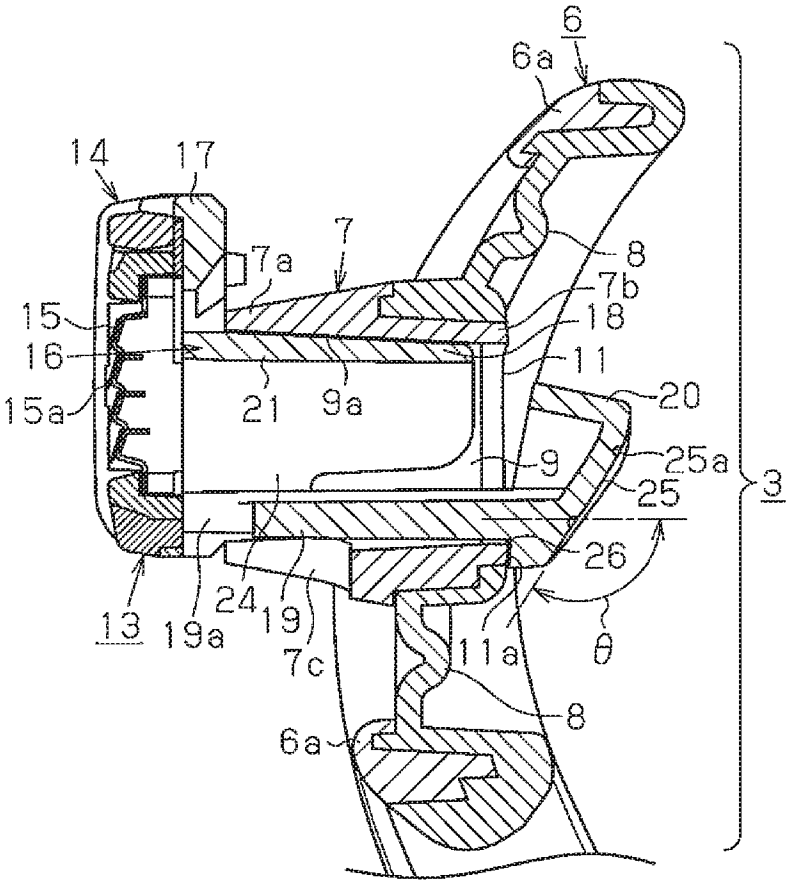
FIG. 2B is a cross-sectional view illustrating the assembled state.
Figure 2A:
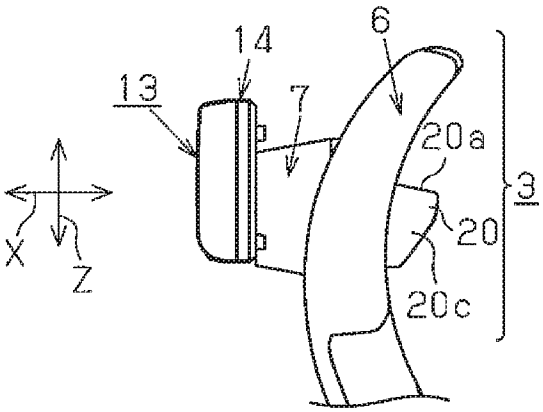
FIG. 2A is a side view illustrating an assembled state of the razor with a detachable blade cartridge shown in FIG. 1.

As shown in FIGS. 2A and 2B, a cylindrical socket portion 7 is arranged at the center of the annular portion 6*a*. An elastic plate 8 is arranged between the outer circumference of the socket portion 7 and the inner circumference of the annular portion 6*a*. The socket portion 7 is molded from the same material as that of the main body portion 4 of the grip portion 2. The elastic plate 8 is integrally molded with the finger contact portion 5 of the grip portion 2 from a rubber material or a soft plastic such as an elastomer plastic and a silicone plastic.

Figures 4A, 4B:
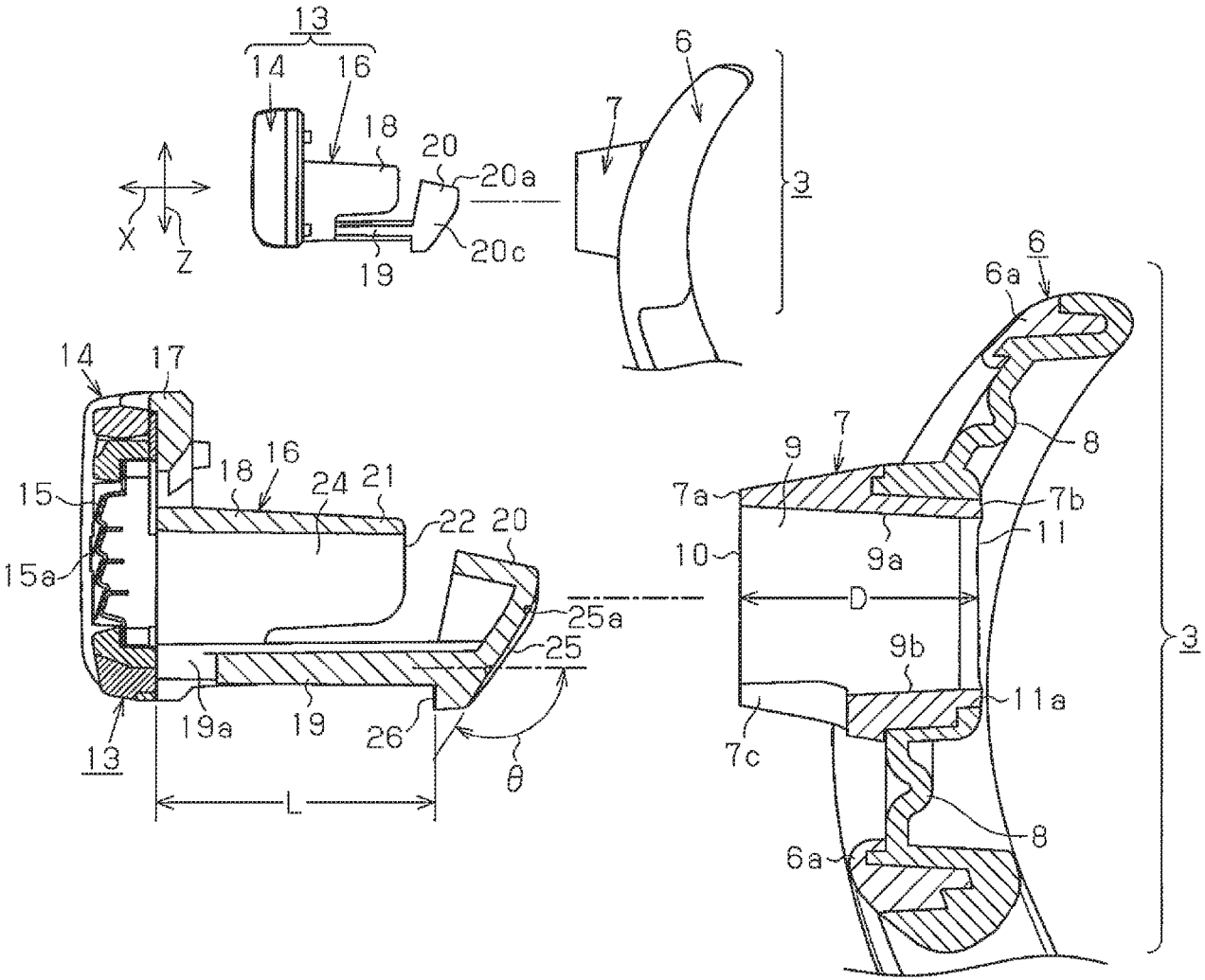
FIG. 4A is an exploded side view partially illustrating the razor with a detachable blade cartridge shown in FIG. 3.
FIG. 4B is an exploded cross-sectional view partially illustrating the razor with a detachable blade cartridge shown in FIG. 3.

As shown in FIG. 4B, the socket portion 7 has a coupler hole 9, which extends in the socket portion 7 along a front-rear axis X. The coupler hole 9 is open at an insertion/ejection opening 10 on the front side and a manipulation opening 11 on the rear side. The socket portion 7 includes a front projection 7*a*, which has the insertion/ejection opening 10, and a rear projection 7*b*, which has the manipulation opening 11. The front projection 7*a* extends forward away from the elastic plate 8. The rear projection 7*b* is located inside the annular portion 6*a* of the support portion 6 and extends rearward. The projecting length of the front projection 7*a* is longer than the projecting length of the rear projection 7*b*. The front projection 7*a* has a cutout portion 7*c* in the lower part. The cutout portion 7*c* extends from the insertion/ejection opening 10 toward the manipulation opening 11.

Figure 3A:
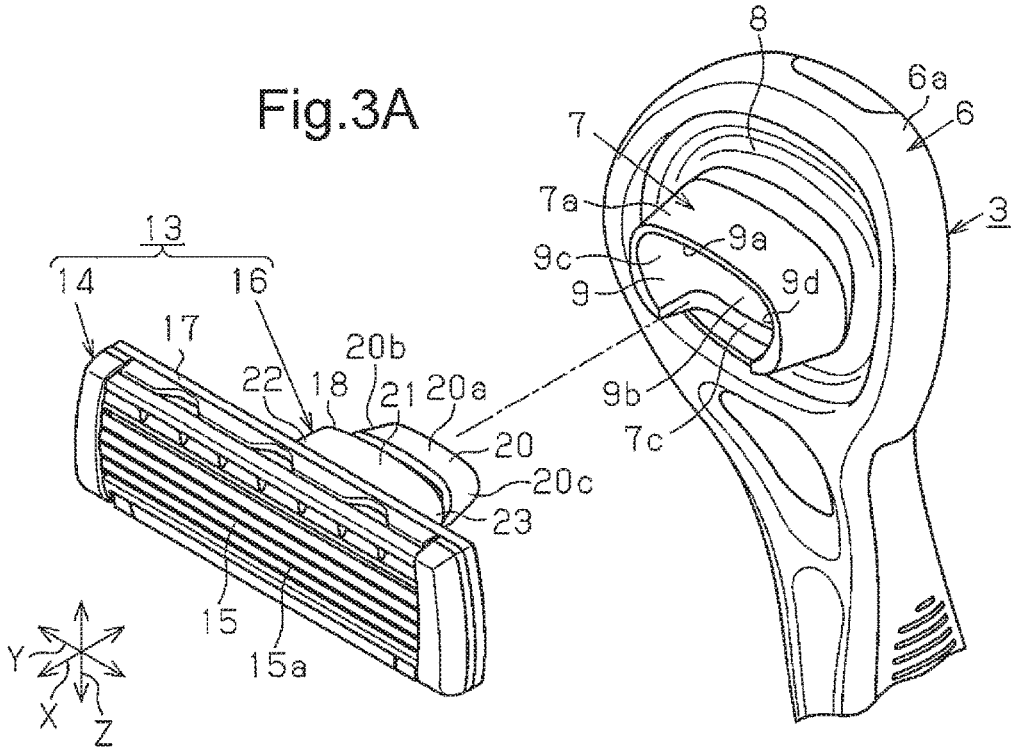
FIG. 3A is an exploded perspective front view partially illustrating the holder with the blade cartridge removed.
Figure 3B:
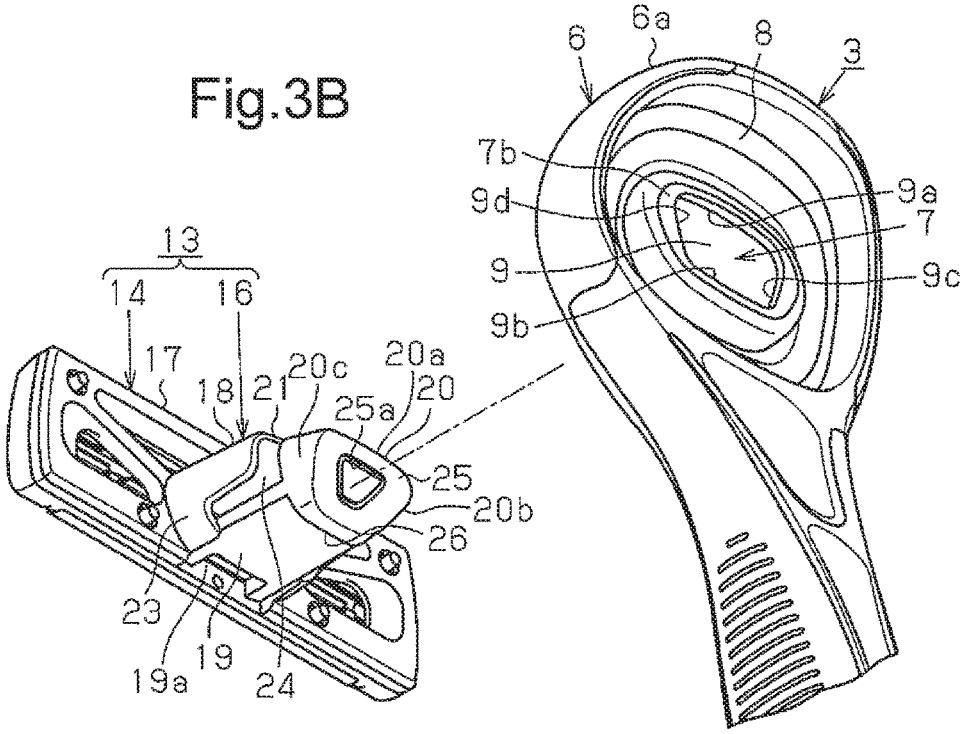
FIG. 3B is an exploded perspective rear view partially illustrating the state with the blade cartridge removed.

As shown in FIGS. 3A and 3B, the coupler hole 9 has a ceiling surface 9*a* and a bottom surface 9*b* extending between the insertion/ejection opening 10 and the manipulation opening 11. The ceiling surface 9*a* and the bottom surface 9*b* face each other along the vertical axis Z and are substantially parallel with each other. In contrast, the distance between a left inner surface 9*c* and a right inner surface 9*d*, which face each other along a lateral axis Y, gradually increases from the bottom surface 9*b* toward the ceiling surface 9*a*.

As shown in FIGS. 4A and 4B, a blade cartridge 13 has a blade assembly 14 and a coupler projection 16. The blade assembly 14 has a plurality of (four in the present embodiment) blades 15. The cutting edges of the blades 15 are arranged on the skin contacting surface. The coupler projection 16 extends from the blade assembly 14 in the opposite direction from the skin contacting surface and toward the support portion 6 of the head portion 3. The blade assembly 14 and the coupler projection 16 are molded from a hard plastic such as an ABS plastic.

The coupler projection 16 includes a guide portion 18, a support portion 19, and a manipulation portion 20. The guide portion 18 extends from a blade base 17 of the blade assembly 14. The support portion 19 is constituted by a cantilever spring and integrated with the lower part of the guide portion 18 to extend in the extending direction of the guide portion 18 (along the front-rear axis X). The manipulation portion 20 is provided in the vicinity of an end of the guide portion 18 to face the distal end of the guide portion 18 and extends upward from the distal end of the support portion 19.

The support portion 19 is flexible and can be deformed along the vertical axis Z. As shown in FIGS. 3A and 3B, the guide portion 18 includes an upper plate portion 21, a left plate portion 22, and right plate portion 23 to have a substantially U-shaped cross-section. A recess 24, which is defined by the upper plate portion 21, the left plate portion 22, and the right plate portion 23, is open toward the support portion 19. The support portion 19 bridges the left plate portion 22 and the right plate portion 23 and has a cutout portion 19*a*, which is located between the support portion 19 and the blade base 17 of the blade assembly 14.

The manipulation portion 20 has an upper surface 20*a*, a left surface 20*b*, a right surface 20*c*, and a pusher surface 25. The pusher surface 25 is tilted from the lower end toward the upper end so that the distance from the skin contact surface of the blade cartridge 13 increases from the lower end toward the upper end. The pusher surface 25 has a recessed shape to fit the finger pulp. The pusher surface 25 has a mark 25*a* surrounded by an annular groove. The mark 25*a* intersects the extending direction of the guide portion 18 (the front-rear axis X). The inclination angle θ of the pusher surface 25 in relation to the central axis of the support portion 19 is set to an angle greater than or equal to 90 degrees, for example, to 123 degrees. The support portion 19 has a step-shaped engagement portion 26 at the distal end. The engagement portion 26 is located at the basal end of the manipulation portion 20. The distance between the outer surface of the left plate portion 22 and the outer surface of the right plate portion 23 gradually increases from the lower end toward the upper end.

When inserting the coupler projection 16 of the blade cartridge 13 into the coupler hole 9 of the holder 1 through the insertion/ejection opening 10 as shown in FIGS. 3A, 3B, 4A, and 4B, the insertion is facilitated by the cutout portion 7*c*, which extends from the insertion/ejection opening 10 toward the manipulation opening 11 and expands the insertion/ejection opening.

During insertion of the coupler projection 16, when the pusher surface 25 of the manipulation portion 20 at the distal end of the support portion 19 contacts the rear end of the cutout portion 7*c*, a component of the force generated at the pusher surface 25 warps the support portion 19 upward and toward the recess 24 of the guide portion 18 against the elastic force of the support portion 19, and the lower surface of the manipulation portion 20 is moved rearward while contacting the bottom surface 9*b* of the coupler hole 9. Thereafter, as the manipulation portion 20 protrudes outward from the manipulation opening 11, the support portion 19 is deformed downward and returns to the original shape due to its elastic force, so that the engagement portion 26 is engaged with an edge 11*a* of the manipulation opening 11. An engaged state shown in FIG. 2 is thus achieved.

In this state, with the cutting edges 15*a* of the blades 15 of the blade cartridge 13 oriented downward (forward direction), the guide portion 18 is located inside the coupler hole 9. In the guide portion 18, the outer surface of the upper plate portion 21, the outer surface of the left plate portion 22, and the outer surface of the right plate portion 23 respectively slide on the ceiling surface 9*a*, the left inner surface 9*c*, and the right inner surface 9*d* of the coupler hole 9. Also, the socket portion 7 is tightly held between the blade base 17 of the blade assembly 14 and the engagement portion 26. This state will be referred to as a holding state, in which the coupler projection 16 of the blade cartridge 13 is held in the coupler hole 9 of the holder 1. As shown in FIG. 4B, the distance D between the insertion/ejection opening 10 and the manipulation opening 11 in the coupler hole 9 is set to be equal to the distance L from the cutout portion 19*a* to the engagement portion 26 in the support portion 19. Thus, when the socket portion 7 holds the blade assembly 14, the socket portion 7 is prevented from rattling. Also, the manipulation portion 20 protrudes and is exposed to the outside from the manipulation opening 11 of the coupler hole 9.

In this manner, with the coupler projection 16 of the blade cartridge 13 held in the coupler hole 9 of the holder 1, the blade cartridge 13 is used by being pressed against the skin surface. At this time, the elastic plate 8 is warped in accordance with the direction and the magnitude of the force generated in the blade cartridge 13, so that the blade cartridge 13 swings in the three axes, that is, the X axis, the Y axis, and the Z axis. During the use, shaving scum that flows out from the blade base 17 of the blade assembly 14 is discharged through the cutout portion 19*a* of the support portion 19.

In contrast, if the blade cartridge 13 is reversed from the downward facing (the forward facing) arrangement shown in FIG. 3A to be oriented upward (in the reverse direction), the outer surface of the right plate portion 23 of the guide portion 18 functions as a restriction portion for the left inner surface 9*c* of the coupler hole 9, and the outer surface of the left plate portion 22 of the guide portion 18 functions as a restriction portion for the right inner surface 9*d* of the coupler hole 9. Thus, if the cutting edges 15*a* of the blades 15 are oriented upward (in the reverse direction), the restriction portions set a holding-disabled state, in which the coupler projection 16 of the blade cartridge 13 cannot be coupled to the coupler hole 9 through the insertion/ejection opening 10.

Also, when the cutting edges 15*a* of the blades 15 of the blade cartridge 13 are oriented downward (in the forward direction), the restriction portion of the socket portion 7, that is, the left inner surface 9*c* and the right inner surface 9*d*, the restriction portion of the guide portion 18, that is, the left plate portion 22 and the right plate portion 23 slide on each other, thereby allowing the coupler projection 16 to be inserted into the socket portion 7. This sets a holding-enabled state.

Operation for removing the blade cartridge 13 from the holder 1 will now be described.

As shown in FIGS. 2B and 4B, the pusher surface 25 of the manipulation portion 20 is inclined in relation to the central axis (not shown), which extends along the front-rear axis X and through the insertion/ejection opening 10 and the manipulation opening 11 of the coupler hole 9, and in relation to the axis that extends in the insertion/ejection direction of the coupler projection 16 in the extending direction (the front-rear axis X) of the guide portion 18. Thus, even in a state in which the engagement portion 26 is engaged with the edge 11*a* of the manipulation opening 11, if the pusher surface 25 is pushed forward in the insertion/ejection direction of the coupler projection 16 in the vicinity of the manipulation opening 11 of the socket portion 7, the pushing force applied to the pusher surface 25 acts as a force in a direction for disengaging the engagement portion 26 and a force for ejecting the blade cartridge 13 from the insertion/ejection opening 10.

The pushing force first warps the support portion 19 upward toward the recess 24 of the guide portion 18, so that the engagement portion 26 is separated from the edge 11*a* of the manipulation opening 11 to be switched to a disengaged state. Further, the pushing force pushes the coupler projection 16 along the front-rear axis X to eject the coupler projection 16 from the insertion/ejection opening 10 of the coupler hole 9, so that the blade cartridge 13 is separated from the holder 1. Even if the upper surface 20*a*, the left surface 20*b*, or the right surface 20*c* of the manipulation portion 20 is pressed, the pushing force does not act as a force in a direction for ejecting the blade cartridge 13 from the insertion/ejection opening 10.

The present embodiment provides the following advantages.

(1) When removing the holder 1 from the blade cartridge 13 in a state in which the coupler projection 16 of the blade cartridge 13 is detachably coupled to the coupler hole 9 of the holder 1, the disengagement of the support portion 19 and the ejection of the blade cartridge 13 can be simultaneously achieved by pushing, in a single ejecting direction of the blade cartridge 13, the manipulation portion 20, which is exposed and extends from the manipulation opening 11 of the coupler hole 9. Thus, a single-stage manipulation by a single-direction pushing force allows the blade cartridge 13 to be easily removed.

(2) The guide portion 18 of the coupler projection 16 extends along the front-rear axis X, which connects the insertion/ejection opening 10 and the manipulation opening 11 of the coupler hole 9, and the pusher surface 25 is provided at an end of the guide portion 18 in the extending direction (the front-rear axis), such that the pusher surface 25 intersects the extending direction of the guide portion 18. This allows a pushing force applied to the manipulation portion 20 of the coupler projection 16 to be readily transmitted to the blade cartridge 13, so that a pushing force in the direction for ejecting the blade cartridge 13 is easily applied to the manipulation portion 20.

(3) The blade cartridge 13 has the coupler projection 16, which includes the support portion 19. The support portion 19 has the engagement portion 26 formed by a step and the manipulation portion 20 at the distal end. The manipulation portion 20 allows the engagement portion 26 to be engaged with or disengaged from the edge 11*a* of the manipulation opening 11 of the coupler hole 9 by utilizing the elasticity of the support portion 19.

(4) The pusher surface 25 of the manipulation portion 20 is inclined in relation to the insertion-removal direction (the front-rear axis X) of the coupler projection 16. Thus, the pushing force generated by pushing the pusher surface 25 with a finger holding the grip portion 2 deforms the support portion 19 and allows the coupler projection 16 to be easily engaged with or disengaged from the coupler hole 9 of the holder 1. Such a pushing force also allows the blade cartridge 13 to be ejected from the insertion/ejection opening 10 of the socket portion 7, thereby canceling the holding of the guide portion 18 to the socket portion 7.

The above described embodiment may be modified as follows.

The manipulation portion 20 may be exposed inside the manipulation opening 11 of the coupler hole 9 without protruding from the manipulation opening 11.

A part of the manipulation portion 20 of the coupler projection 16 that is located outside the socket portion 7 of the holder 1 may be covered with a flexible cover made, for example, of a plastic. In this case, the manipulation portion 20 is pushed via the flexible cover.

The guide portion 18 of the coupler projection 16 of the blade cartridge 13 and the coupler hole 9, which connects the insertion/ejection opening 10 and the manipulation opening 11 to each other in the socket portion 7 of the holder 1, do not necessarily need to extend linearly along the front-rear axis X, but may extend along an arcuate line. In that case, engagement and disengagement of the coupler projection 16 are achieved along an arcuate line.

The elastic plate 8 may be omitted from the head portion 3 of the holder 1. In that case, the coupler hole 9 may be formed directly in the head portion 3 so that swinging motion is not permitted. Alternatively, a swinging structure other than the elastic plate 8 may be employed. For example, the blade cartridge 13 may have a swinging structure between the blade assembly 14 and the coupler projection 16.

The support portion 19 and the engagement portion 26 may be replaced by a structure with a recess and a corresponding projection or a structure with magnets in the coupler projection 16 and the coupler hole 9, so that the blade cartridge 13 is detachably held by the head portion 3 of the holder 1.

The support portion 19, the engagement portion 26, and the manipulation portion 20 do not necessarily need to be provided on the lower side of the guide portion 18, but may be provided on the upper side, the left side, or the right side.

In addition to the restriction portions, which are provided between the left inner surface 9*c* and right inner surface 9*d* of the coupler hole 9 and between the right plate portion 23 and the left plate portion 22 of the guide portion 18, other restriction portions may be employed.

The cross-sectional shape of the socket portion 7 of the holder 1 and the cross-sectional shape of the coupler projection 16 of the blade cartridge 13 may be varied.

As long as the blade cartridge 13 can be coupled to the holder 1, the shape of the blade assembly 14 may be varied. Also, the number of the blades 15 of the blade assembly 14 may be other than four. For example, the number may be less than or equal to three and greater than or equal to five.

The guide portion 18 may be omitted from the coupler projection 16 of the blade cartridge 13, and a curved portion, which replaces the guide portion 18, may be provided in the support portion 19, so that the curved portion slides along the ceiling surface 9*a* of the coupler hole 9.

The coupler projection of the blade cartridge 13 may be entirely molded from a soft plastic, and the elasticity of the coupler projection may be used to detachably press-fit the coupler projection into the coupler hole.

DESCRIPTION OF THE REFERENCE NUMERALS

1 . . . Holder, 2 . . . Grip Portion of Holder, 3 . . . Head Portion of Holder, 7 . . . Socket Portion of Head Portion, 9 . . . Coupler hole of Socket Portion, 10 . . . Insertion/ejection Opening of Coupler hole, 11 . . . Manipulation Opening of Coupler hole, 11*a* . . . Edge of Manipulation Opening, 13 . . . Blade cartridge, 16 . . . Coupler projection of Blade cartridge, 18 . . . Guide Portion of Coupler projection, 19 . . . Support Portion of Coupler projection, 20 . . . Manipulation Portion of Coupler projection, 25 . . . Pusher surface of Manipulation Portion, 26 . . . Engagement Portion of Support Portion.

The invention claimed is:

1. A razor comprising a holder and a blade cartridge that has a skin contacting surface, wherein the holder comprises a head portion for detachably holding the blade cartridge, and the holder includes a grip portion, an upper end of the grip portion being continuous with the head portion, the head portion comprising:

an annular portion;

a socket portion arranged within an inner circumference of the annular portion; and an elastic plate arranged between an outer circumference of the socket portion and the inner circumference of the annular portion so that the elastic plate elastically supports the socket portion, the blade cartridge comprising:

a blade assembly having a plurality of blades;

a coupler projection extending from the blade assembly in an opposite direction from the skin contacting surface of the blade cartridge;

a guide portion included in the coupler projection of the blade cartridge; and a manipulation portion formed at an end of the guide portion, wherein the socket portion has a coupler hole extending therethrough along a front-rear axis, the coupler hole opens at an insertion/ejection opening in front of the elastic plate and a manipulation opening behind the elastic plate, both the coupler hole and the manipulation opening are aligned to each other along the front-rear axis, the coupler projection is configured to be detachably coupled to the coupler hole through the insertion/ejection opening, the manipulation portion has a pusher surface and is configured to extend through the socket portion of the holder to expose the pusher surface behind the elastic plate via the manipulation opening, when the coupler projection is coupled into the coupler hole, and the manipulation portion is operable with a single-stage manipulation by pushing the pusher surface with one finger of a hand that holds the grip portion from a rearward of the holder when removing the blade cartridge from the insertion/ejection opening of the socket portion.

2. The razor according to claim 1, wherein the manipulation portion of the blade cartridge is provided in a support portion formed on the guide portion of the coupler projection.

3. The razor according to claim 2, wherein the support portion of the guide portion includes an engagement portion having an elasticity, and the engagement portion is switchable between a state in which the engagement portion is capable of engaging the coupler projection with the socket portion through elastic deformation, and a state in which the engagement portion is capable of disengaging the coupler projection from the socket portion against the elasticity of the engagement portion.

4. The razor according to claim 3, wherein the support portion of the guide portion is constituted by a cantilever spring having the engagement portion.

5. The razor according to claim 4, wherein the engagement portion of the support portion is a step portion that is engaged with and disengaged from an edge of the manipulation opening of the socket portion.

6. The razor according to claim 4, wherein the pusher surface is inclined in relation to a direction in which the coupler projection is inserted into and ejected from the socket portion of the holder.

7. The razor according to claim 6, wherein the pusher surface of the manipulation portion extends along a line that intersects with a longitudinal direction of the grip portion so that the pusher surface inclines rearward such that an upper end of the pusher surface is distanced away from the skin contacting surface.

8. The razor according to claim 7, wherein with the guide portion of the coupler projection coupled to the socket portion of the holder, the socket portion is held between the blade assembly of the blade cartridge and the engagement portion of the support portion.

9. The razor according to claim 1, wherein the socket portion of the holder and the guide portion of the coupler projection of the blade cartridge each have a restriction portion, the razor is configured to be switchable between a holding-enabled state, in which, with cutting edges of blades in the blade cartridge oriented in a forward direction, the restriction portion of the socket portion and the restriction portion of the guide portion slide on each other to permit the coupler projection to be inserted into the socket portion, and a holding-disabled state, in which, if an orientation of the blade cartridge is reversed so that the cutting edges of the blades are oriented in a reverse direction, the restriction portion of the socket portion and the restriction portion of the guide portion restrict insertion of the coupler projection into the socket portion.

* * * * *